United States Patent [19]

Phillips

[11] 4,157,090

[45] Jun. 5, 1979

[54] SHORT-TERM EMERGENCY SURVIVAL BREATHING AND EYE-SHIELDING

[76] Inventor: Jacque R. Phillips, 835 Fountain Ave., Lancaster, Pa. 17601

[21] Appl. No.: 851,679

[22] Filed: Nov. 15, 1977

[51] Int. Cl.[2] ..... A62B 7/00

[52] U.S. Cl. ..... 128/141 R; 128/146.7; 46/1 F; 2/206

[58] Field of Search ..... 128/141 R, 142 R, 142.2, 128/142.3, 142.4, 142.6, 142.7, 145 R, 146, 146.2, 146.3, 146.4, 146.5, 146.6, 146.7, 205, 212; 46/1 F; 2/206

[56] References Cited

U.S. PATENT DOCUMENTS

| | | | |
|---|---|---|---|
| 3,018,776 | 1/1962 | Saitta et al. | 128/142.4 |
| 3,049,121 | 8/1962 | Brumfield et al. | 128/146.2 |

*Primary Examiner*—Henry J. Recla

*Attorney, Agent, or Firm*—John F. McClellan, Sr.

[57] ABSTRACT

A short-term emergency survival breathing and eye-shielding mask provides for one hand "slap-on" self-clinging and sealing application to the face by means of finger-tubes which extend from storage within adjacent pneumatic tubing sealing around the face, to a position around the head on inflation by a self-contained flask; a second such flask provides breathing air; the flasks may be valved by impact on the user's chin by means of a common bar.

15 Claims, 5 Drawing Figures

SHORT-TERM EMERGENCY SURVIVAL BREATHING AND EYE-SHIELDING

This invention relates generally to safety devices and specifically to masks for supplying air and facial protection in noxious atmospheres.

A principal object of the present invention is to provide an emergency survival mask system which deploys over the face from compactly folded mode and clings to a user's head so quickly and with one-hand operation that it may truly be termed a "slap-on" mask or "slap-deployment" mask.

Numerous mask disclosures appear in the prior art, including those of the following U.S. Pat. Nos.

1,105,127 to A. B. Brager, 7-28-14, discloses pneumatic fitting of a mask to contours of the wearer's head;

2,875,757 to E. A. Galleher, Jr., 3-3-59 discloses pneumatic marginal shaping and sealing of mask structure to fit the wearer's face;

3,505,998 to J. R. Halstead et al, 4-14-70, discloses plural arms terminating rearwardly in individual fastening means for securing a mask;

3,545,437 to John J. Quackenbush, 12-8-70, discloses two separate compartments for fluid with separate fillers for separate sources in face wash structure;

3,599,636 to Georges M. Gutman, 8-17-71, discloses inflatable head-harness in a face mask; and 3,750,665 to Fedoer Stranicky discloses inflatable structure with respirator apparatus.

However, it is believed that no combination of the above provides the structure or advantages of the present invention as exemplified by the objects of this invention.

Further objects are to provide a system as described which provides for survival long enough to escape many emergencies, which weighs little, takes up little space, costs little, is durable and reliable in operation, requires a minimum of instruction or practice to use, and is efficiently compartmented to insure both breathing and deploying pneumatic-reserves.

In brief summary given for cursive descriptive purposes only, the invention includes a mask having separate breathing and deployment pneumatic structures, adapted for one-hand instant-application and self clinging affixation.

The above and other objects and advantages of the invention will become more readily apparent on examination of the following description, including the Figures, in which like reference numerals indicate like parts:

Figure 1:
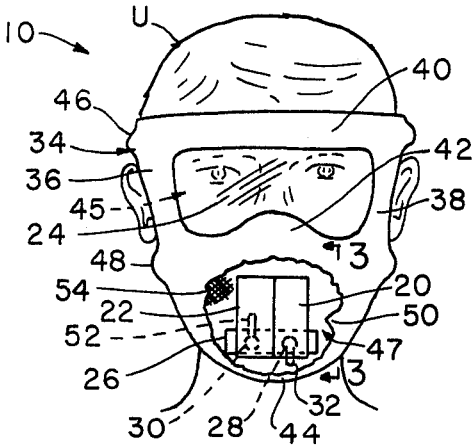
FIG. 1 is a front elevation partly broken away for exposition, of the invention deployed and in use.
Figure 2:
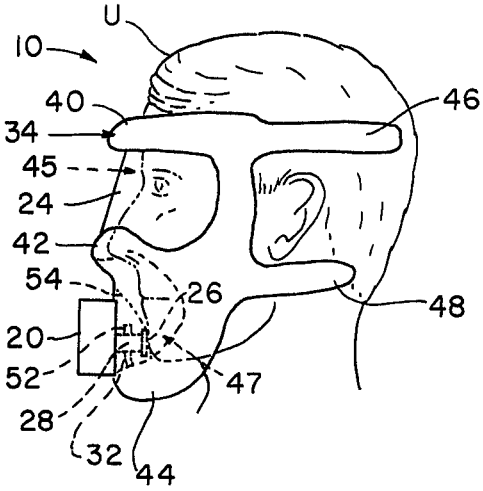
FIG. 2 is a side elevation thereof.

FIGS. 1 and 2 show the invention 10 in use in protecting a user U from a toxic atmosphere containing smoke or similar noxious fumes, by providing a mask-deploying source of gas in the form of a first small, high pressure flask 20 and a short term supply of gas for breathing from a similar flask 22. The flask may be affixed to the lower part of the front of the mask as shown, below the transparent eye shield 24.

An actuator-bar 26 when pressed against the user's chin on application of the undeployed mask to the face admits gas to both subsystems from the respective flasks. Any suitable conventional valves 28, 30 may be used for the purpose, those shown being detailed in a later Figure as frangible-tip protrusions. Preferably the type valve used is an impact-responsive valve, which means a quick opening valve which stays open when the opening force is relieved.

For inflation, gas from flask 20 passes through lead 32 to the channel system 34 which is generally in the shape of a face framing broad figure eight in face view, having on each side an upright tube 36, 38 joined across the forehead, nose and beneath the chin by cross-tubes 40, 42 and 44 respectively, all together defining two enclosures or compartments, one 45 at the eyes and the other 47 below, around the mouth and nostrils.

Deploying rearwardly around the head from the upright tubular portions on each side are two fingerlike gripping tubes or paired opposed arms, the upper 46 extensible above the ear and the lower 48 below the ear, each ending in a closed free end curved around behind the head.

The upper opening in the figure eight frames the eye shield.

The compartment around the nostrils and mouth defined by the tubular members 42, 44 inflated by the first flask has a flexible cover 50 joining the outer surface of the tubular members; this is the breathing compartment. Into this, gas flows from the second flask through lead 52. A large-area filter 54 may be supplied across the mouth and nostrils. Inhaling tends to seal the boundary tubing to the face and exhaling and excess pressure from the flask tend to force the tubing away, permitting exhaust.

Figure 3:
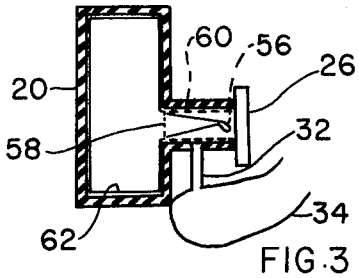
FIG. 3 is a detail adapted from 3—3 of FIG. 1 and largely in section.

FIG. 3 details one conventional form of valve usable, a frangible-tip protrusion 56 which may be glass joined to a high pressure metal jacket forming the flask by a glass-to-metal seal 58. The protrusion may have a local sleeve-type particle filter 60 and the entire unit may have an integral flexible cover 62 of glass-filament reinforced rubber or the like. Integral also with the cover may be the lead 32.

The mask, including the cover over the breathing compartment over the nostrils and mouth may be of elastomeric material such as rubber or themoplastic, the eye shield being preferably of thin flexible transparent material such as transparent 0.0005 inch (0.0125 mm) thick "Mylar" or other suitable polyester. The actuator bar may be thin metal or rigid plastic, and rubber covered on the outside.

Figure 4:
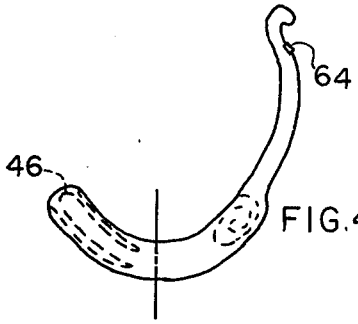
FIG. 4 is a plan view.

FIG. 4 shows in plan view one arrangement in which the gripping tubes 46 and 48 (not shown), may be stored prior to deployment longitudinally returned or refolded on itself within the preferably larger diameter cross tubes. On the right side the nearly deployed, uncoiling relation of the tube is shown. An alternative method of storage for this may be employed, coiled within the cross tube (phantom lines), coiling may be either with or against the curvature of the shape in plan when deployed.

A small conventional pressure relief valve 64 may be employed to help match inflation flask capacity and system capacity.

Figure 5:
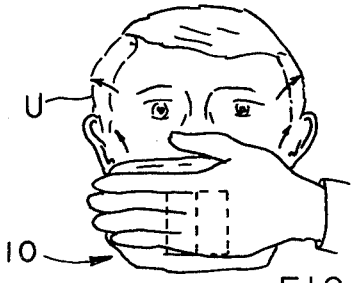
FIG. 5 is a front elevation of the invention in preinflation mode being applied.

FIG. 5 shows "slap-on" one-hand application of the mask, the top part of which is starting to snap upward into position (arrows), following which the folded finger-like gripping tubes will be freed to pop out and deploy when the adjacent cross tubes fill out to full diameter.

It is evident that speed of deployment can be made very great by using a large diameter inflation valve passage, one eighth inch (5 mm) diameter for example, with flask pressure perhaps in the order of one hundred pounds per square inch.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by U.S. Letters Patent is:

1. In a facemask including means for supplying breathing mixture and for shielding a user's face in emergency, the improvement comprising: means for unfolding and deploying the facemask across a user's face in response to slapping the facemask against the user's face, including means for securing the facemask on the user's head in response to said deployment of the facemask across a user's face.

2. In a facemask as recited in claim 1 wherein said facemask and securing means include inflatable tubular members and the means for unfolding and deploying including means for inflating said inflatable tubular members.

3. In a facemask as recited in claim 2, the inflating means including a source of compressed gas having connection with said inflatable tubular members and impact—responsive means for admitting gas from said source to said inflatable tubular members upon said slapping of the facemask against a user's face.

4. In a facemask including means for supplying breathing mixture and for shielding a user's face in emergency, the improvement comprising: means for unfolding and deploying the facemask across a user's face in response to slapping the facemask against a user's face, including means for securing the facemask on the user's head in response to said slapping of a portion of the facemask against a user's face; said facemask and securing means including inflatable tubular members and said means for unfolding and deploying including means for inflating said inflatable tubular members, said inflating means including a source of compressed gas having connection with said inflatable tubular members and impact-responsive means for admitting gas from said source to said frame part of the facemask upon said slapping of the facemask against a user's face, and said impact-responsive means having orientation relative to the facemask for striking a portion of a said user's face upon said slapping of the facemask against a said user's face.

5. In a facemask as recited in claim 4, said inflatable tubular members including said means for securing and comprising structure proportioned for extending upon inflation around a user's head.

6. In a facemask as recited in claim 5, said inflatable tubular members including a boundary portion having shape for fitting around a user's face.

7. In a facemask as recited in claim 6, said structure including a first pair of opposed arms positioned for passing around an upper part of a user's head.

8. In a facemask as recited in claim 7, said structure further comprising a second pair of opposed arms for passing around a lower part of a user's head.

9. In a facemask as recited in claim 8, the facemask having a transparent flexible eyeshield, and the inflatable tubular members being generally in the shape of a figure-eight, with the eyeshield in the upper opening of the figure-eight shape.

10. In a facemask as recited in claim 9, a cover over the lower opening in the figure eight shape forming a breathing enclosure; a second said source of compressed gas, said second source having connection with the breathing enclosure.

11. In a facemask as recited in claim 10, second impact-responsive means for admitting gas from said second source through said connection with the breathing enclosure.

12. In a facemask as recited in claim 11, the second impact-responsive means located for striking a portion of a user's face for slap actuation.

13. In a facemask as recited in claim 12, an impact bar connecting the first said and the second impact-responsive means for assuring simultaneous operation.

14. In a facemask as recited in claim 7, said first pair of arms having a pre-deployment folded position, said pre-deployment folded position being within said inflatable tubular members.

15. In a facemask as recited in claim 14, said folded position being with each said arm returned in itself.

* * * * *